US010830240B2

(12) United States Patent
Eschner

(10) Patent No.: US 10,830,240 B2
(45) Date of Patent: Nov. 10, 2020

(54) MAGNETIC DRIVE PUMP

(71) Applicant: Klaus Union GmbH & Co. KG, Bochum (DE)

(72) Inventor: Thomas Eschner, Bochum (DE)

(73) Assignee: Klaus Union GmbH & Co. KG, Bochum (DE)

( * ) Notice: Subject to any disclaimer, the term of this patent is extended or adjusted under 35 U.S.C. 154(b) by 161 days.

(21) Appl. No.: 16/087,110

(22) PCT Filed: Mar. 22, 2017

(86) PCT No.: PCT/EP2017/056881
§ 371 (c)(1),
(2) Date: Sep. 21, 2018

(87) PCT Pub. No.: WO2017/162775
PCT Pub. Date: Sep. 28, 2017

(65) Prior Publication Data

US 2019/0113038 A1 Apr. 18, 2019

(30) Foreign Application Priority Data

Mar. 22, 2016 (DE) ..... 10 2016 105 309

(51) Int. Cl.
*F04D 13/02* (2006.01)
*F04D 13/06* (2006.01)
(Continued)

(52) U.S. Cl.
CPC ..... *F04D 13/026* (2013.01); *F04D 13/024* (2013.01); *F04D 13/025* (2013.01);
(Continued)

(58) Field of Classification Search
CPC .... F04D 13/024; F04D 13/026; F04D 13/062; F04D 13/064; F04D 13/0606; F04D 13/0633
See application file for complete search history.

(56) References Cited

U.S. PATENT DOCUMENTS 4,808,087 A * 2/1989 Tsutsui ..... F04D 13/064 417/369
5,256,038 A * 10/1993 Fairman ..... F04D 29/108 417/423.11
(Continued)

FOREIGN PATENT DOCUMENTS

DE 3622269 A1 * 1/1988 ..... F04D 13/0633
DE 4009199 9/1991
(Continued)

OTHER PUBLICATIONS

Internationaler Recherchenbericht und der Schriftliche Bescheid [International Search Report and the Written Opinion] dated Jul. 26, 2017 From the Internationalen Recherchenbehörde [International Searching Authority] Re. Application No. PCT/EP2017/056881 and its Translation of Search Report Into English. (13 Pages).

*Primary Examiner* — Patrick Hamo

(57) ABSTRACT

The invention relates to a magnetic drive pump (10), comprising:
- a housing (12) filled at least partially with a conveyed fluid;
- an impeller chamber (14) enclosed by the housing (12);
- a pump shaft (22);
- an impeller (24) which is arranged in the impeller chamber (14) and on the pump shaft (22);
- a bearing (26) which supports the pump shaft (22) in the housing (12);
- a can (18) which encloses a coupling chamber (20);

(Continued)

a rotor (50) which is arranged in the coupling chamber (20) on the pump shaft (22);

a ring (16) held in the housing, which supports the bearing (26) and separates the impeller chamber (14) from the coupling chamber (20);

a duct (28) formed in the ring (16) for conveying a partial flow of the conveyed fluid out of the impeller chamber (14) to the bearing (26) for the purpose of lubricating the bearing (26), wherein at least part of the conveyed fluid emerging from the bearing (26) arrives in the coupling chamber (20). The object of the invention is to improve a magnetic drive pump of this type such that safe and reliable lubrication of the bearing (26) of the pump shaft (22) over a certain time is also still ensured when the pump (10) is operating in dry-run condition, i.e. when it continues running when there is no more conveyed fluid on the suction side of the pump (10). The invention achieves this object in that the coupling chamber (20) is closed in fluid-tight manner relative to the impeller chamber (14).

11 Claims, 1 Drawing Sheet

(51) Int. Cl.

| | |
|---|---|
| ***F04D 29/046*** | (2006.01) |
| ***F04D 29/06*** | (2006.01) |
| ***F04D 29/10*** | (2006.01) |
| ***F04D 29/42*** | (2006.01) |
| ***F04D 29/58*** | (2006.01) |

(52) U.S. Cl.

CPC ..... *F04D 13/0606* (2013.01); *F04D 29/046* (2013.01); *F04D 29/061* (2013.01); *F04D 29/106* (2013.01); *F04D 29/426* (2013.01); *F04D 29/586* (2013.01)

(56) References Cited

U.S. PATENT DOCUMENTS

| | | | | |
|---|---|---|---|---|
| 5,397,220 | A * | 3/1995 | Akihisa | F04D 29/047 417/369 |
| 6,457,951 | B2 * | 10/2002 | Rennett | F04D 13/026 417/365 |
| 2001/0043871 | A1 | 11/2001 | Rennett et al. | |
| 2009/0035161 | A1 * | 2/2009 | Grann | F04D 13/0633 417/423.3 |
| 2016/0177962 | A1 * | 6/2016 | Laing | F04D 29/0473 417/423.13 |
| 2017/0122324 | A1 * | 5/2017 | Meuter | F04D 7/06 |

FOREIGN PATENT DOCUMENTS

| | | | | |
|---|---|---|---|---|
| EP | 0814275 | | 12/1997 | |
| GB | 1069896 | A * | 5/1967 | F04D 29/2283 |

* cited by examiner

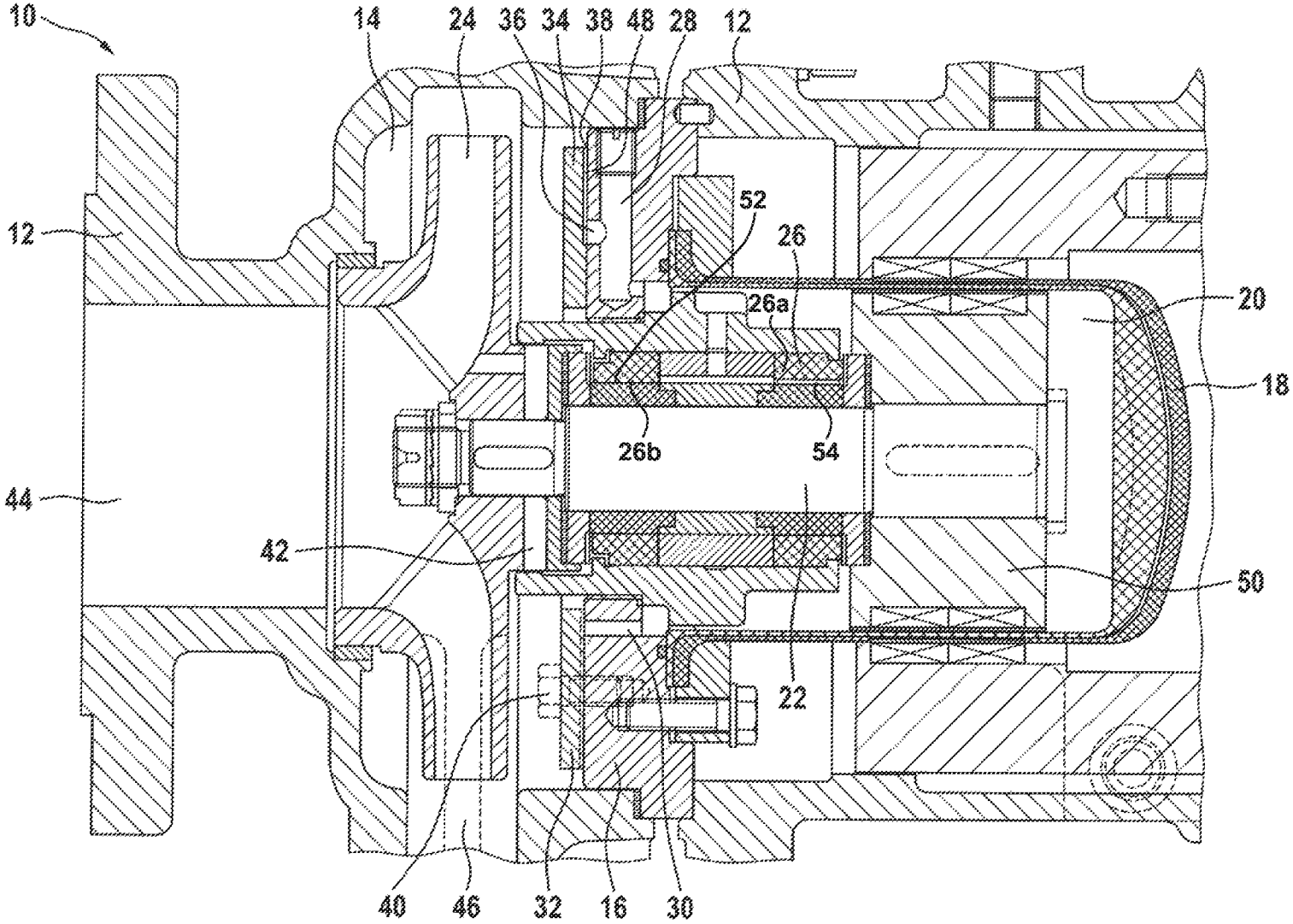
10
12
14
24
36
34
38
48
28
12
52
26
26a
20
18
50
54
26b
22
30
16
32
46
40
42
44

MAGNETIC DRIVE PUMP

RELATED APPLICATIONS

This application is a National Phase of PCT Patent Application No. PCT/EP2017/056881 having International filing date of Mar. 22, 2017, which claims the benefit of priority of German Patent Application No. 10 2016 105 309.0 filed on Mar. 22, 2016. The contents of the above applications are all incorporated by reference as if fully set forth herein in their entirety.

FIELD AND BACKGROUND OF THE INVENTION

The invention relates to a magnetic drive pump.

Magnetic drive pumps have been known from the prior art for a long time.

They are a combination of conventional pump hydraulics with a drive system which has a usually permanent-magnetic coupling. Magnetic drive pumps utilize the attractive and repulsive forces between permanent magnets in both coupling halves for contactless and slip-free torque transmission. The drive power is transmitted in a contactless and slip-free manner from an electric motor via a drive shaft, which is connected to an outer rotor, to a rotor which bears pump-side magnets (inner rotor). The rotor drives an impeller via a pump shaft. The pump shaft in this case is supported in the housing of the pump by a bearing which is lubricated by the conveyed fluid. A can is arranged between the two rotors. The can separates the conveyed fluid from the environment. The conveyed fluid in magnetic drive pumps is thus separated from the environment exclusively by means of static seals, so that the conveyed fluid is prevented particularly safely from leaking into the environment. Therefore, magnetic drive pumps are frequently used in the chemical and petrochemical sector.

The bearing is lubricated in magnetic drive pumps by the conveyed fluid of the pump, with a partial flow of the conveyed fluid which is necessary to that end being taken from the impeller chamber at a point of high pressure, passing through the bearing to be lubricated and arriving via the bearing in the impeller chamber and in the coupling chamber which is enclosed by the can. The conveyed fluid is recirculated into the impeller chamber via a drainage bore which connects the coupling chamber to a point of low pressure in the impeller chamber. The conveyed fluid exiting into the coupling chamber via the bearing at the same time cools the can and dissipates the heat produced there by eddy currents.

What is disadvantageous is that when the known magnetic drive pumps are operating in dry-run condition, no sufficient lubrication of the bearing or cooling of the can is possible, since the partial flow required for lubrication or cooling continues to leave the bearing and the coupling chamber continuously, but no new partial flow which is required for the lubrication/cooling can be fed in, since no more conveyed fluid is present. Within a very short time, overheating occurs and the bearing is destroyed.

It is therefore the object of the invention to provide a magnetic drive pump in which safe and reliable lubrication of the bearing of the pump shaft over a certain time is also still ensured when the pump is operating in dry-run condition, i.e. when it carries on running when there is no more conveyed fluid left on the suction side of the pump, e.g. because of an operating error.

This object is achieved by a magnetic drive pump having the features of claim 1. Advantageous configurations are in each case the subject-matter of the dependent claims. It should be pointed out that the features individually listed in the claims may also be combined with one another in any technologically reasonable manner whatsoever and thus set forth further configurations of the invention.

A magnetic drive pump according to the invention comprises:

- a housing filled at least partially with a conveyed fluid;
- an impeller chamber enclosed by the housing;
- a pump shaft;
- an impeller which is arranged in the impeller chamber on the pump shaft;
- a bearing which bears the pump shaft in the housing;
- a can which encloses a coupling chamber;
- a rotor which is arranged in the coupling chamber on the pump shaft;
- a ring held in the housing, which supports the bearing and separates the impeller chamber from the coupling chamber;
- a duct formed in the ring for conveying a partial flow of the conveyed fluid out of the impeller chamber to the bearing for the purpose of lubricating the bearing, wherein at least part of the conveyed fluid emerging from the bearing arrives in the coupling chamber.

In this case, the above object is achieved according to the invention in that the coupling chamber is closed in (virtually) fluid-tight manner relative to the impeller chamber.

The magnetic drive pump according to the invention has the advantage over the prior art that sufficient lubrication of the bearing is also ensured over a longer period when the pump is operating in dry-run condition and no further conveyed fluid can be conveyed through the duct to the bearing.

Owing to the fact that according to the invention, unlike in the prior art, the coupling chamber is closed in fluid-tight manner relative to the impeller chamber, i.e. at most a slight recirculation of the conveyed fluid out of the coupling chamber directly into the impeller chamber takes place, the conveyed fluid flows significantly more slowly out of the region of the bearing. Thus the bearing remains sufficiently lubricated over a considerably longer period, even if no conveyed fluid is replenished via the duct.

The conveyed fluid arrives not only in the coupling chamber, but also in the impeller chamber, via the bearing. The conveyed fluid therefore arrives back in the impeller chamber even without the draining which conventionally takes place from the coupling chamber, so that circulation of the conveyed fluid which serves as a lubricant is ensured during normal operation of the pump according to the invention. In dry-run condition, the conveyed fluid which exits into the impeller chamber via the bearing is replenished from the coupling chamber. The conveyed fluid present in the coupling chamber is sufficient to maintain the lubrication over a longer period (up to one hour or even longer) until it is noticed that the pump is in dry-run condition and the pump is switched off.

Preferably the can consists of a non-metallic material. Owing to the lack of electrical conductivity of the non-metallic material, eddy-current losses are avoided, as a result of which the efficiency of the magnetic drive pump increases significantly. In particular, unlike in the prior art, no cooling of the can by the conveyed fluid is necessary. The reduced circulation of the conveyed fluid caused by the closure according to the invention of the coupling chamber relative to the impeller chamber is thus unproblematic with regard to the cooling in combination with the non-metallic material of the can. Preferably the can consists of engineering ceramic or plastics, such as for example PEEK. Cans made of plastics are characterized by their low weight and their low fragility and ease of handling. Cans made of ceramic (e.g. SiC) have great pressure resistance and excellent heat resistance.

In a preferred configuration of the magnetic drive pump according to the invention, at least one restriction element is provided which restricts the throughflow of the conveyed fluid through the duct. As a result, the circulation of the conveyed fluid via the partial flow and via the bearing is further slowed. Due to the reduction in the throughflow, an accumulation of particles in the coupling chamber is prevented. The restriction element may to this end cover or close e.g. the input-side opening of the duct to the impeller chamber. The restriction element may be formed e.g. in a disc shape and be fastened to the ring, so that it partially covers the opening of the duct. Particularly preferably, a ring disc fastened to the ring can form the restriction element and at the same time closes a drainage bore formed in the ring which is originally provided to connect the coupling chamber to the impeller chamber. In this manner, as part of a carry-over parts strategy the parts of a conventional magnetic drive pump can be used at low cost for a pump configured according to the invention. It is merely necessary to attach the additional ring disc, preferably in combination with the use of a non-metallic can. Advantageously, the ring disc partially closes the duct in order to reduce the cross-section to restrict the flow of fluid, and completely closes the drainage bore. In order to prevent an accumulation of particles in the coupling chamber in the event of the flow of fluid being laden with solids, the restriction element is arranged in the inflow, so that the throughflow of the conveyed fluid through the duct is restricted. The restriction element to this end is embodied such that particles have to move radially inwards into the duct against the centrifugal force in order to enter the coupling chamber. The partial flow of the conveyed fluid which enters the coupling chamber out of the impeller chamber to the bearing for the purpose of lubricating the bearing is considerably reduced by the restriction element, as a result of which the introduction of particles into the can in the event of the flow of fluid being laden with solids is reduced.

Preferably, the pump shaft does not have a fluidic connection between the impeller chamber and coupling chamber. Conventionally, the pump shaft comprises an axial through-bore in order to ensure sufficient circulation of the conveyed fluid from the pressure side of the impeller chamber via the bearing into the coupling chamber, and through the pump shaft back to the suction side of the impeller chamber for the purpose of sufficient cooling of the can. Owing to the lack of a fluidic connection via the pump shaft, the circulation is reduced according to the invention, and as a result the coupling chamber remains filled with conveyed fluid over as long a period as possible in dry-run condition in order to maintain the lubrication. The pump shaft may be formed as a solid body. It is however also possible for the pump shaft to be formed as a hollow shaft which is closed at least at one end.

One preferred embodiment provides for recirculation of the conveyed fluid out of the coupling chamber into the impeller chamber to take place via the bearing. The recirculation of the conveyed fluid out of the coupling chamber into the impeller chamber preferably takes place exclusively via the bearing. As a result, sufficient lubrication of the bearing over a longer period is ensured, even if the pump is operating in dry-run condition and no further conveyed fluid can be conveyed through the duct to the bearing.

The recirculation of the conveyed fluid out of the coupling chamber into the impeller chamber takes place in the region of the bearing, so that the bearing is sufficiently lubricated over a considerably longer period, even if no conveyed fluid is replenished via the duct. The conveyed fluid therefore re-arrives in the impeller chamber, so that circulation of the conveyed fluid, which serves as lubricant, during normal operation of the pump according to the invention is ensured. In dry-run condition, the conveyed fluid which emerges into the impeller chamber via the bearing is replenished from the coupling chamber. The conveyed fluid present in the coupling chamber is sufficient to maintain the lubrication over a longer period (up to one hour or even longer). Thus, the pump can be switched off without damage as soon as it is noticed that the pump is in dry-run condition.

In a preferred configuration of the magnetic drive pump according to the invention, provision is made for the recirculation of the conveyed fluid out of the coupling chamber into the impeller chamber to take place via a radial bearing gap in the bearing. The radial bearing gap is preferably located between the bearing elements of the bearing, so that lubrication is ensured even when the pump is in dry-run condition.

A further advantageous embodiment is that the radial bearing gap is arranged on the impeller side in the bearing. The radial bearing gap restricts the recirculation of the conveyed fluid out of the coupling chamber into the impeller chamber. The radial bearing gap in the impeller-side radial bearing of the bearing preferably does not have a lubrication groove, in order to restrict the recirculation of the conveyed fluid further. Since flushing of the bearing in the event of the conveyed fluid being laden with solids thereby does not occur, the introduction of particles into the coupling chamber through the restriction element described above and below should be reduced.

The embodiment, in which lubrication grooves are arranged on the coupling side in the bearing is particularly advantageous. The coupling-side radial bearing of the bearing may comprise lubrication grooves through which flushing between the bearing elements is ensured. This is of significant importance in the event of the conveyed fluid being laden with solids in order nevertheless to ensure great longevity of the bearing.

The invention and its technical context will be discussed in greater detail below with reference to the FIGURES. It should be pointed out that the FIGURES show a particularly preferred variant embodiment of the invention. The invention is however not limited to the variant embodiment shown. In particular, the invention, in so far as it is technically reasonable, covers any combinations whatsoever of the technical features which are outlined in the claims or are described in the description as being relevant to the invention.

BRIEF DESCRIPTION OF THE SEVERAL VIEWS OF THE DRAWINGS

The FIGURES show in:

FIG. 1 a sectional view of a magnetic drive pump according to the invention.

FIG. 1 shows a magnetic drive pump 10 according to the invention in one possible configuration. The magnetic coupling comprises a housing 12 with a ring 16. The housing 12 includes an impeller chamber 14 for receiving a conveyed fluid which is drawn in through an inlet 44 and is ejected through an outlet 46. Further, the pump 10 comprises a can 18, wherein the can 18 and the ring 16 enclose a coupling chamber 20. The ring 16 separates the coupling chamber 20 from the impeller chamber 14. The can 18 consists of a non-metallic material, so that no heat generation due to eddy currents occurs therein. A pump shaft 22 extends from the impeller chamber 14 through a central opening provided in the ring 16 into the coupling chamber 20. An impeller 24 is fastened to the pump shaft 22. At the other end of the shaft 22, a rotor 50 equipped with permanent magnets is arranged in the coupling chamber 20. For bearing the pump shaft 22, the pump 10 has a bearing 26, e.g. in the form of a plain bearing with ceramic bearing elements, which is supported by the ring 16. Further, a duct 28 for supplying a partial flow of the conveyed fluid from the impeller chamber 14 to the bearing 26 is provided in the ring 16 for the purpose of lubrication. The ring 16 comprises a drainage bore 30 which is originally provided for draining the coupling chamber 20 into the impeller chamber 14. The opening of the drainage bore 30 facing the impeller chamber 14 is closed by means of a disc-shaped element 32. As a result, according to the invention the coupling chamber 20 is closed in fluid-tight manner relative to the impeller chamber 14. In this manner, it is ensured that a sufficient quantity of conveyed fluid for lubricating the bearing 26 in dry-run condition remains in the coupling chamber 20 over a certain time. Recirculation of the conveyed fluid out of the coupling chamber 20 into the impeller chamber 14 takes place via the bearing 26. The exclusive recirculation of the conveyed fluid via the bearing 26 out of the coupling chamber 20 into the impeller chamber 14 provides a sufficient quantity of conveyed fluid for lubricating the bearing 26 over a longer period. The disc-shaped element 32 is fastened to the ring 16 by means of a screw 40. The recirculation of the conveyed fluid out of the coupling chamber 20 into the impeller chamber 14 therefore takes place via a radial bearing gap 52 in the bearing 26. The radial bearing gap 52 is arranged between the bearing elements of the impeller-side radial bearing 26*b* of the bearing 26, which ensures lubrication between the bearing elements even when the pump is in dry-run condition. The radial bearing gap 52 restricts the recirculation of the conveyed fluid out of the coupling chamber 20 into the impeller chamber 14. As can be seen, the impeller-side radial bearing 26*b* of the bearing 26 does not comprise a lubrication groove, in order to restrict the recirculation of the conveyed fluid. In the coupling-side radial bearing 26*a* of the bearing 26, a lubrication groove 54 can be discerned which ensures sufficient flushing between the bearing elements. The impeller 24 comprises a hollow-cylindrical portion 42 which extends in the axial direction of the pump shaft 22 and adjoins the disc-shaped element 32.

The leaking of conveyed fluid out of the bearing 26 into the impeller chamber 14 is limited by the gap between the disc-shaped element 32 and the portion 42. A restriction element 34 which is arranged between the impeller chamber 14 and the opening 36 of the duct 28 is provided. The restriction element 34 prevents any accumulation of particles in the coupling chamber in the event of the flow of fluid being laden with solids. The restriction element 34 restricts the throughflow of the conveyed fluid through the duct 28. The restriction element 34 is formed on the disc-shaped element 32 and covers the duct opening 36. The restriction element 34, according to the invention, rests against the duct opening 36 such that the conveyed fluid can flow into the region between the restriction element 34 and duct opening 36. To this end, the restriction element 34 comprises on its outer circumference a chamfer 38 which is arranged on the side of the element 32 remote from the impeller 24. A gap 48 through which conveyed fluid can flow into the duct 28 is produced between the restriction element 34 and ring 16. The restriction element 34 in this manner effects that particles to have to move radially inwards into the duct 28 against the centrifugal force, in order to enter the coupling chamber 20. The partial flow of the conveyed fluid which arrives in the coupling chamber out of the impeller chamber 14 to the bearing 26 for the purpose of lubricating the bearing 26 is considerably reduced by the restriction element 34, as a result of which the introduction of particles into the can 18 in the event of the flow of fluid being laden with solids is reduced. The restriction element 34 in this manner restricts the flow of conveyed fluid through the duct 28. The pump shaft 22 of the magnetic drive pump 10 is formed such that it does not produce a fluidic connection between the coupling chamber 20 and the impeller chamber 14. To this end, the pump shaft 22 is formed as a solid body.

LIST OF REFERENCE CHARACTERS

10 magnetic drive pump
12 housing
14 impeller chamber
16 ring
18 can
20 coupling chamber
22 pump shaft
24 impeller
26 bearing
26*a* coupling-side radial bearing
26*b* impeller-side radial bearing
28 duct
30 drainage bore
32 disc-shaped element
34 restriction element
36 duct opening
38 chamfer
40 screw
42 impeller end region running in the longitudinal direction
44 inlet
46 outlet
48 gap
50 rotor
52 radial bearing gap
54 lubrication groove

The invention claimed is:

1. A magnetic drive pump (10), comprising:
a housing (12) filled at least partially with a conveyed fluid;
an impeller chamber (14) enclosed by the housing (12);
a pump shaft (22);
an impeller (24) which is arranged in the impeller chamber (14) and on the pump shaft (22);
a bearing (26) which supports the pump shaft (22) in the housing (12);
a can (18) which encloses a coupling chamber (20);
a rotor (50) which is arranged in the coupling chamber (20) and on the pump shaft (22);
a ring (16) held in the housing, which supports the bearing (26) and separates the impeller chamber (14) from the coupling chamber (20);
a duct (28) formed in the ring (16) for conveying a partial flow of the conveyed fluid out of the impeller chamber (14) to the bearing (26) for the purpose of lubricating the bearing (26), wherein at least part of the conveyed fluid emerging from the bearing (26) arrives in the coupling chamber (20), wherein the coupling chamber (20) is closed in fluid-tight manner such that recirculation of the conveyed fluid out of the coupling chamber (20) into the impeller chamber (14) takes place only via the bearing (26).

2. The magnetic drive pump (10) according to claim 1, wherein the can (18) is produced from a non-metallic material.

3. The magnetic drive pump (10) according to claim 1, further comprising at least one restriction element (34) which restricts the throughflow of the conveyed fluid through the duct (28).

4. The magnetic drive pump (10) according to claim 3, wherein the at least one restriction element (34) partially covers or closes the opening of the duct (28) to the impeller chamber (14).

5. The magnetic drive pump (10) according to claim 4, wherein the restriction element (34) is formed in a disc shape and is fastened to the ring (16), so that it at least partially covers the opening of the duct (28).

6. The magnetic drive pump (10) according to claim 3, wherein a ring disc (32) fastened to the ring (16) forms the at least one restriction element (34) and at the same time closes a drainage bore (30) formed on the ring (16), which bore connects the coupling chamber (20) to the impeller chamber (14).

7. The magnetic drive pump (10) according to claim 1, wherein the pump shaft (22) does not have a fluidic connection between the impeller chamber (14) and coupling chamber (20).

8. The magnetic drive pump (10) according to claim 1, wherein the pump shaft (22) is formed as a solid body.

9. The magnetic drive pump (10) according to claim 1, wherein recirculation of the conveyed fluid out of the coupling chamber (20) into the impeller chamber (14) takes place via a radial bearing gap (52) in the bearing (26).

10. The magnetic drive pump (10) according to claim 9, wherein the radial bearing gap (52) is arranged on the impeller side in the bearing (26).

11. The magnetic drive pump (10) according to claim 1, wherein lubrication grooves (54) are arranged on the coupling side in the bearing (26).

* * * * *